United States Patent [19]

de Pingon

[11] 4,337,715

[45] Jul. 6, 1982

[54] ARTICULATED CATAMARAN

[76] Inventor: Pierre J. de Pingon, 7 avenue du Parmelan, 74000 Annecy, France

[21] Appl. No.: 194,300

[22] PCT Filed: May 31, 1979

[86] PCT No.: PCT/FR79/00046

§ 371 Date: Feb. 8, 1980

§ 102(e) Date: Feb. 5, 1980

[87] PCT Pub. No.: WO80/00018

PCT Pub. Date: Jan. 10, 1980

[51] Int. Cl.[3] ..... B63B 1/22

[52] U.S. Cl. ..... 114/121; 114/61; 114/191

[58] Field of Search ..... 114/284, 191, 61, 261, 114/121, 122, 283

[56] References Cited

U.S. PATENT DOCUMENTS

| | | | |
|---|---|---|---|
| 705,731 | 7/1902 | Ach | 114/191 |
| 1,558,567 | 10/1925 | Schein | 114/122 |
| 2,047,922 | 7/1936 | Seligmann | 114/191 X |
| 2,119,775 | 6/1938 | Chase | 114/61 |
| 2,206,100 | 7/1940 | McCormick | 114/191 |
| 2,325,993 | 8/1943 | Zoll | 114/261 |
| 2,466,164 | 4/1949 | Evans | 114/191 |
| 2,617,376 | 11/1952 | Evans | 114/191 |
| 2,617,377 | 11/1952 | Evans | 114/191 |
| 3,218,015 | 11/1965 | Baer | 114/191 X |

FOREIGN PATENT DOCUMENTS

| | | | |
|---|---|---|---|
| 786808 | 9/1935 | France | 114/191 |
| 2058786 | 5/1971 | France . | |
| 168628 | 9/1921 | United Kingdom | 114/191 |
| 792680 | 9/1958 | United Kingdom . | |

*Primary Examiner*—Trygve M. Blix
*Assistant Examiner*—Harry A. Smith
*Attorney, Agent, or Firm*—Young & Thompson

[57] ABSTRACT

This invention relates to a boat of the catamaran type comprising two elongated floats interconnected by a beam system carrying a cockpit. The beam system is connected to each float by a transverse articulation oriented perpendicular to the longitudinal axis of these floats. Structure comprising a differential is provided between the beam system and each float to maintain this beam system in a mean position relative to the floats. This differential may be of the hydraulic or mechanical type and under the control of a gyroscope. The cockpit is mounted at the middle of the beam system and is articulated about an axis oriented according to the longitudinal axis of the boat. Structure, such as a jack controlled by a gyroscope, is provided to maintain the cockpit in a horizontal position. A boat of this type, endowed with good stability, is useful particularly as a pleasure craft, passenger craft or as a service craft.

6 Claims, 5 Drawing Figures

ARTICULATED CATAMARAN

The present invention relates to a boat of the catamaran type, that is to say a boat comprising two hulls or floats united by a framework or a cockpit.

It is known that this type of boat has good stability and is endowed with a better speed compared with single-hulled boats. However, by the very fact of its design, stresses which may be very considerable in heavy weather are transmitted to the connections between the hulls or floats and the framework connecting them.

One object of the invention is to permit the production of a boat of this type arranged in such manner as to put an end to the stresses on the connections between the hulls or floats and the framework connecting them, also allowing the floats to move up and down in two planes parallel to the plane of symmetry of the vessel independently of one another and according to the shape of the liquid surface, thus obtaining better riding of the waves and a better behaviour in bad weather.

Another object of the invention is to produce a boat of this type arranged in such manner that the cockpit provided on the framework connecting the floats permanently maintains a horizontal position.

Thus, the invention relates to a boat combining at one and the same time qualities of good seaworthiness, speed and stability of the cockpit, suitable most particularly for pleasure, passenger transport and service (customs, coastguard, weather, etc . . .) boats or vessels.

It has already been proposed, as disclosed in U.S. Pat. No. 2,119,775 to connect two boat hulls through a transverse beam, whereby said hulls can pivot with respect to said beam, which can support a loading platform. However, in this case, there is provided between the two hulls, forwardly and rearwardly with respect to said beam, connecting members which are also connected to said platform, the assembly thus forming a complex system the elements of which can hardly admit the forces which are generated when such a vessel is moving on sea. The invention brings a simple and efficient solution to this problem through the use of a differential system.

The invention thus relates to a catamaran comprising two elongated floats interconnected by a beam system bearing a cockpit, wherein the beam system is connected to each float by a transverse articulation directed perpendicularly to the longitudinal axis of the float, characterized in that means constituting a differential are provided between this beam system and each float so as to maintain the axial plane of symmetry of the beam system in a mean position with respect to the floats.

According to one possible embodiment, this differential system is of hydraulic type and comprises in each case at least one jack interposed between one end of the beam and the float coupled to that end, the two jacks or sets of jacks provided at the two ends being interconnected to maintain the axial plane of symmetry of the beam system in a mean position with respect to the floats. The desired result may be obtained in particular by providing, between the beam system and the floats, double-acting jacks whose corresponding chambers are connected together.

According to another possible embodiment, the differential system is of mechanical type and between the ends of the beam system and each float there is provided one or more levers, the ends of these levers acting on the beam system being interconnected, for example by a compensating bar, so as to produce the compensation required for maintaining the axial plane of symmetry of the beam system in the aforesaid mean position.

According to another feature of the invention, the differential system provided between the beam system and the floats is under the control of a gyroscope, so that the median axial plane of the beam system may be maintained in a vertical position. In the case of a hydraulic differential system, the desired result can be obtained by connecting the chambers of the jacks to a device forming a valve and to a source of liquid and by placing this device forming a valve and (or) the source of liquid under the control of the gyroscope. In the case of a mechanical differential system, this result can be obtained by providing in the lever system, in particular in the connecting compensating bar associated with the beam system, a length adjusting device which is under the control of a gyroscope.

According to yet another feature of the invention, the cockpit forming the useful body of the boat is mounted in articulated fashion on the connecting beam system, in the centre of this system, on a horizontal shaft in the axial plane of the boat, position control means being provided between the cockpit and the beam system for maintaining the cockpit substantially in a vertical position, whatever the position of transverse inclination of the boat and, consequently, of the beam system. According to an embodiment, these means may be under the control of a gyroscope system. For example, one or more jacks connected to a valve system and to a source of fluid may be provided between the cockpit and the beam system, it being then possible for the valve system to be under the control of a gyroscope system.

According to a suitable arrangement, the cockpit is mounted on the beam system in a position such that its centre of gravity is substantially in plumb, i.e. vertically aligned with the said beam system. Thus, the forces required to be supplied by the aforesaid means are relatively small. If this centre of gravity of the cockpit is also located in plumb with the articulating shaft of the cockpit on the beam system, a limited force also has to be supplied by the means, in particular the jack or jacks, serving to maintain the cockpit in a horizontal transverse position.

In this way, the position of the cockpit is controlled longitudinally and laterally and it remains horizontal without requiring any great expenditure of energy whatever the movements of the sea.

According to still another feature, each float is constituted by an envelope of elongated form provided at its front end with a turned-up portion in the form of a prow. Each envelope also carries a propeller and a rudder towards its rear end.

The following description given with reference to the accompanying drawings, which are given non-limitatively, will enable the invention to be better understood.

Figure 1:
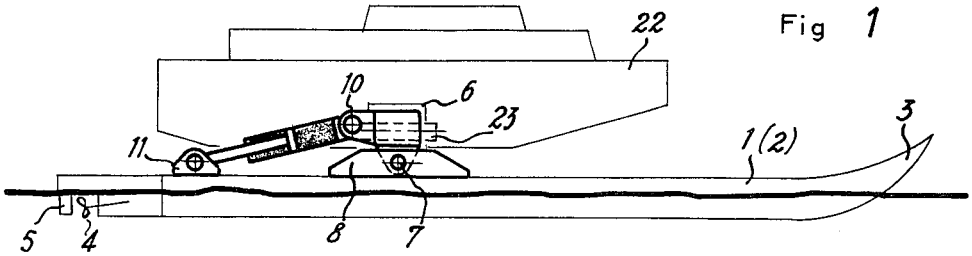
FIG. 1 is a diagrammatic elevational view of a boat of the catamaran type produced according to the invention.

In the drawings, reference numerals 1 and 2 designate the flotation elements of the boat, which are constituted by two long envelopes or floats turned up at the front in the form of a prow, as shown at 3. These floats, which are of great length, have a tapered shape so as to provide on the one hand, by reason of their increased length, better riding of the waves and, on the other hand, a greater speed of propulsion. Each float is provided with a propeller 4 and a rudder 5 at its rear end. The arrangement of the means driving the propellers and controlling the rudders is not shown in the drawings. Determination of this arrangement is within the reach of those skilled in the art, who will be able to make direct application of the technical principles known in this field for the propulsion and steering of existing boats.

Figure 2:
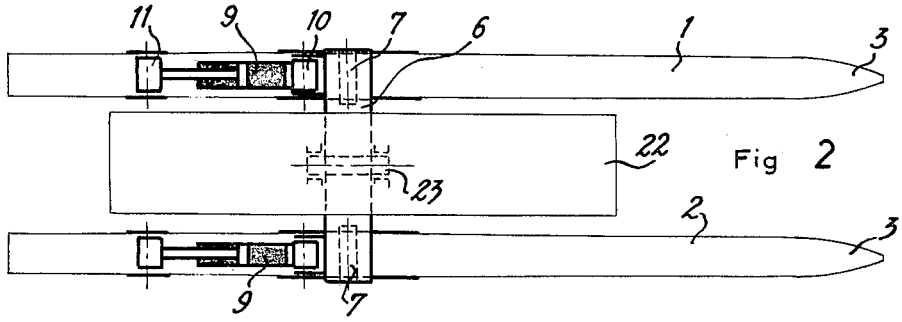
FIG. 2 is a corresponding plan view.

According to the invention, between the two floats 1 and 2 there is provided a transverse beam designated by the reference 6, which is mounted at its ends by means of shafts 7 in bearings 8 carried by the floats. The shafts 7 provided at the ends of the beam 6 are aligned with each other and they are oriented perpendicularly to the longitudinal plane of symmetry of the boat. As can be seen in the drawings, these shafts 7 have a length sufficient to keep the floats 1 and 2 parallel directionally to the longitudinal axis of the boat. At the same time, they permit movement of these floats up and down in two vertical planes which are parallel to the axial plane of the boat. If reference is made first of all to the embodiment shown in FIGS. 1 and 2, it will be seen that between each of the ends of the beam 6 and the corresponding floats 1 and 2 there is provided in each case a double-acting hydraulic jack 9 which is articulated by its body at 10 to the corresponding end of the beam and by the end of its piston rod to the associated float 1 or 2 at 11.

Figure 5:
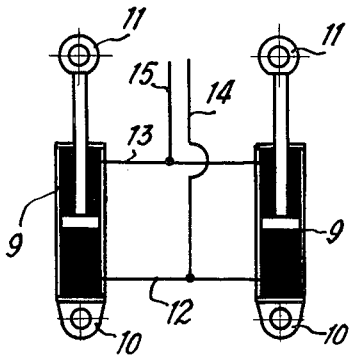
FIG. 5 is a detail view indicating diagrammatically the method of connection provided between the jacks of a differential of hydraulic type.

According to the invention, these two jacks are interconnected in the manner shown diagrammatically in FIG. 5. Thus, conduits 12 and 13 connect the corresponding chambers of the jacks together. It will be understood that in this way, if one of the floats 1 and 2 tends to undergo a movement or displacement in a vertical plane about the associated shaft 7, by reason of the connection established between the jacks, a movement of the other float which is equal and of opposite direction is going to occur, so as to tend to maintain the axial plane of symmetry of the beam 6, which is at right angles to the axial plane of the boat, in a means position with respect to the floats.

FIG. 5 also shows conduits 14 and 15 which can be connected to a valve system associated with a source of liquid. It will be understood that by placing the valve system then provided under the control of a gyroscope it is possible to control the supply of the jacks so as to keep the beam 6 constantly in a position such that its plane of symmetry remains vertical.

Figure 3:
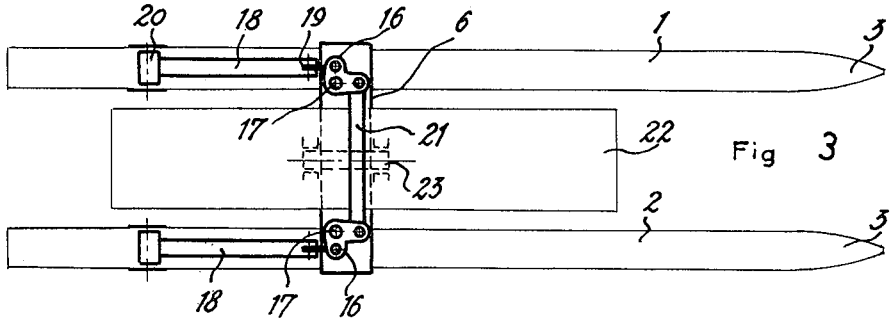
FIG. 3 is a plan view similar to FIG. 2, but comprising a mechanical differential.

FIG. 3 shows a compensating system of mechanical type. In this case, bell-crank transmission levers 16 are provided towards the ends of the beam 6, the levers being pivotally mounted on the beam on normally vertical spindles 17. One arm of each lever is acted on by a bar 18 connected to the lever 16 at one end by means of an articulation 19, while the other end of the bar 18 is articulated at 20 to the corresponding float 1, 2. The other arms of the two transmission levers 16 are interconnected by a compensating bar 21.

The way in which this mechanical differential system acts will be easily understood. In this case again, on the movement or displacement of one float in one direction in a vertical plane a pivoting of the corresponding lever 16 about its spindle 17 occurs and this movement is transmitted by the compensating bar 21 to the other lever 16 and by the other bar 18 to the other float, which in this way undergoes a movement of the same amplitude and of opposite direction.

In this case, moreover, it is possible, for example, to combine with the compensating bar 21 a length adjusting device under the control of a gyroscope, so as to vary the length of the compensating bar and, thus, the relative positions of the floats with respect to the beam 6 in order to maintain the median longitudinal plane of the beam in a vertical position.

The catamaran according to the invention also includes a cockpit which forms its useful body and which is shown diagrammatically in the drawings at 22.

According to the invention, this cockpit is mounted on the transverse beam 6 in the middle of the length of the beam, that is to say in the median longitudinal plane of the boat, by means of a shaft 23 oriented along this median longitudinal plane of the boat and journalled in suitable bearings provided in the cockpit and in the beam. This shaft is directed perpendicularly to the median axial plane of the beam, that is to say it normally occupies a horizontal position.

Figure 4:
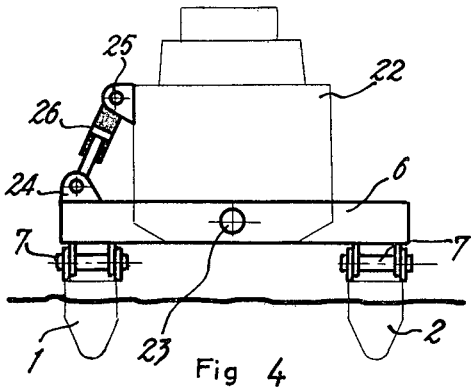
FIG. 4 is a diagrammatic end view showing the lateral control system provided for the cockpit.

In the case of the embodiment illustrated and as can be seen in particular in FIG. 4, between a bearing 24 provided at one end of the beam 6 and a bearing 25 provided on the cockpit there is provided a jack 26 which is connected to a valve system (not shown) under the control of a gyroscope, so as to maintain the cockpit in a vertical position whatever the transverse inclination of the beam 6.

The cockpit is arranged in such manner with respect to the beam 6 that its centre of gravity is located in plumb with the beam.

It will thus be understood, by reading the foregoing description, that an articulated assembly is obtained wherein the floats can move up and down independently according to the state of the sea, held by the shafts of great length in two planes parallel to the axial longitudinal plane of the boat. The differential system maintains the beam supporting the cockpit in a mean position with respect to the two floats and there are only very small stresses in the connections.

Moreover, the described combination of means enables the position of the cockpit to be controlled longitudinally and transversely in such manner that, whatever the movements of the sea, the cockpit remains horizontal. In this way the result is increased comfort for the occupants of the boat.

On account of the mounting used, this result is achieved, moreover, with a small expenditure of energy, since the position of the centre of gravity of the cockpit is in plumb with the transverse beam and by reason of the articulated mounting of the cockpit at the centre of the beam, also in plumb with its centre of gravity, for transverse stabilization.

The use of floats of great length which are free to adopt their relative positions also permits better riding of the waves, and therefore improved seaworthiness, which property is added to the general good behaviour already known per se of boats of the catamaran type. It is also appropriate to add that, for a given power, the speed of a boat of this type is increased since it depends, for the same tonnage and the same power, on the length and slenderness of the hull, which is formed in the present case by two long and tapered floats.

Modifications may be made in the embodiments described within the range of technical equivalents without departing from the invention.

I claim:

1. In a catamaran comprising two elongated floats each having a longitudinal axis, a beam extending between and interconnected at its ends to said floats for vertical swinging movement of said floats relative to said beam about a horizontal axis perpendicular to said longitudinal axes, and a cockpit mounted on said beam; the improvement comprising links pivotally interconnecting each end of the beam and the associated float, means for altering the lengths of said links simultaneously in opposite directions, means mounting the cockpit on the beam for vertical swinging movement of the cockpit and beam relative to each other about a horizontal axis disposed between the floats, and means acting between the beam and the cockpit to maintain the cockpit upright upon movement of the beam to an inclined position.

2. A catamaran as claimed in claim 1, the last-named horizontal axis being equidistant from said floats, the center of gravity of the cockpit overlying said beam.

3. A catamaran as claimed in clain 1, each said link comprising a hydraulic jack comprising a cylinder and a piston, and a hydraulic conduit interconnecting said cylinders on the same sides of said jacks.

4. A catamaran as claimed in claim 3, and a hydraulic conduit interconnecting said cylinders on the other sides of said pistons.

5. A catamaran as claimed in claim 1, said links comprising bell cranks pivotally mounted on the ends of the beams for swinging movement about vertical axes, a bar pivotally interconnecting one end of each bell crank to the associated float, and a bar pivotally interconnecting the other ends of the bell cranks to each other.

6. A catamaran as claimed in claim 1, said means to maintain the cockpit upright comprising a hydraulic jack.

* * * * *